US005123189A

United States Patent [19]

Fast et al.

[11] Patent Number: 5,123,189

[45] Date of Patent: Jun. 23, 1992

[54] FORWARDLY EXTENDING IDENTIFICATION TAG

[75] Inventors: Jacob Fast; Robert A. Fast, both of Plantation, Fla.; John W. Gebka, Chicago Heights, Ill.

[73] Assignee: Fast Industries, Inc., Fort Lauderdale, Fla.

[21] Appl. No.: 707,304

[22] Filed: May 29, 1991

Related U.S. Application Data

[63] Continuation of Ser. No. 476,302, Feb. 7, 1990, abandoned.

[51] Int. Cl.[5] ..... G09F 3/10

[52] U.S. Cl. ..... 40/299; 40/657; 211/59.1; 248/220.4

[58] Field of Search ..... 40/642, 124.1, 124.4, 40/657, 308, 316, 299, 539; 211/57.1, 59.1; 248/221.1, 220.3, 222.1, 220.4

[56] References Cited

U.S. PATENT DOCUMENTS

| | | | |
|---|---|---|---|
| 2,204,129 | 6/1940 | Englar | 40/539 |
| 2,578,548 | 12/1951 | Histed | 40/665 |
| 2,711,038 | 6/1955 | Sinder et al. | 40/539 |
| 3,534,864 | 10/1970 | Larson | 248/220.4 |
| 4,394,909 | 7/1983 | Valiulis et al. | 248/220.4 |
| 4,525,944 | 7/1985 | Fast . | |
| 4,665,639 | 5/1987 | Fast | 40/124.4 |
| 4,703,570 | 11/1987 | Fast . | |
| 4,715,135 | 12/1987 | Fast . | |
| 4,754,563 | 7/1988 | Fast | 40/124.1 |
| 4,760,660 | 8/1988 | Fast | 40/308 |
| 4,773,172 | 9/1988 | Fast | 40/657 |
| 4,823,964 | 4/1989 | Lundberg | 248/220.4 |
| 4,934,080 | 6/1990 | Karnes et al. | 40/642 |
| 4,991,335 | 2/1991 | Krautsack | 40/539 X |

*Primary Examiner*—Kenneth J. Dorner
*Assistant Examiner*—Brian K. Green
*Attorney, Agent, or Firm*—Fleit, Jacobson, Cohn, Price, Holman & Stern

[57] ABSTRACT

A display tag, of sheet material, for use on a forwardly extending support hook is provided. It has a mounting portion on one end for securing it to the proximal end of a support hook, and an elongate portion adjacent the mounting portion for extending forwardly of the hook to present product information at a distal end of the elongate portion. The tag has one or more flaps or tabs which are die-cut therein and provided with bar receiving cut-outs for receiving a forwardly extending part of a support hook therein. In one embodiment, four tabs are provided on the mounting portion of the tag for receiving mutually perpendicular extending bars of a bi-directional wire rack therein. The bar receiving cut-outs in the tabs are circular or elongate in shape and stabilize the tag in the longitudinal direction on the support hook.

21 Claims, 5 Drawing Sheets

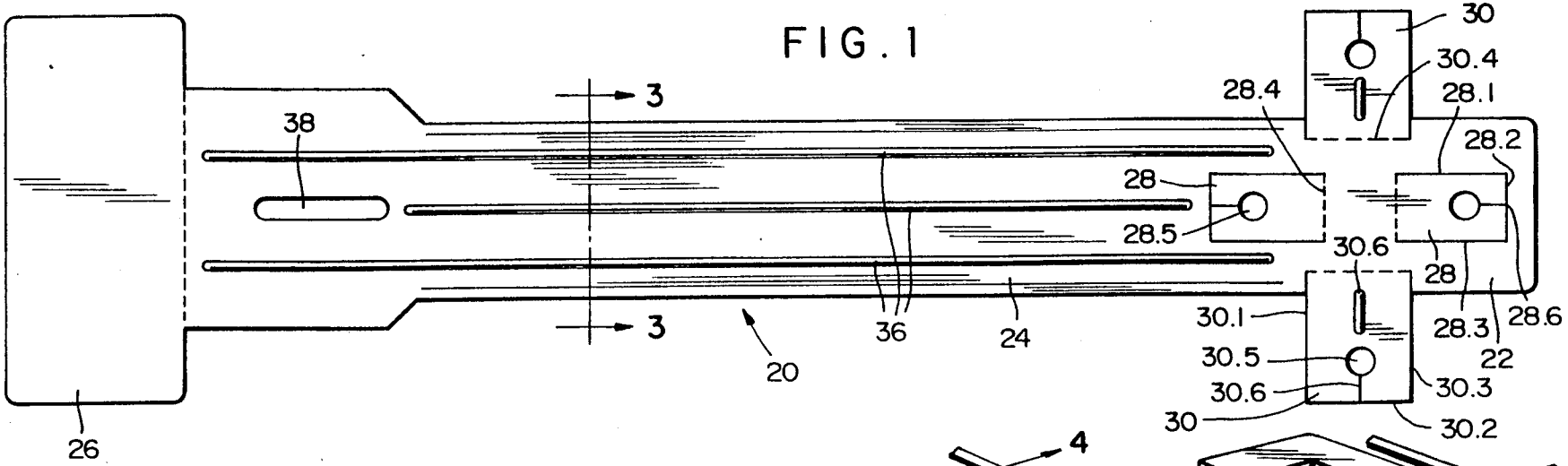
FIG. 1
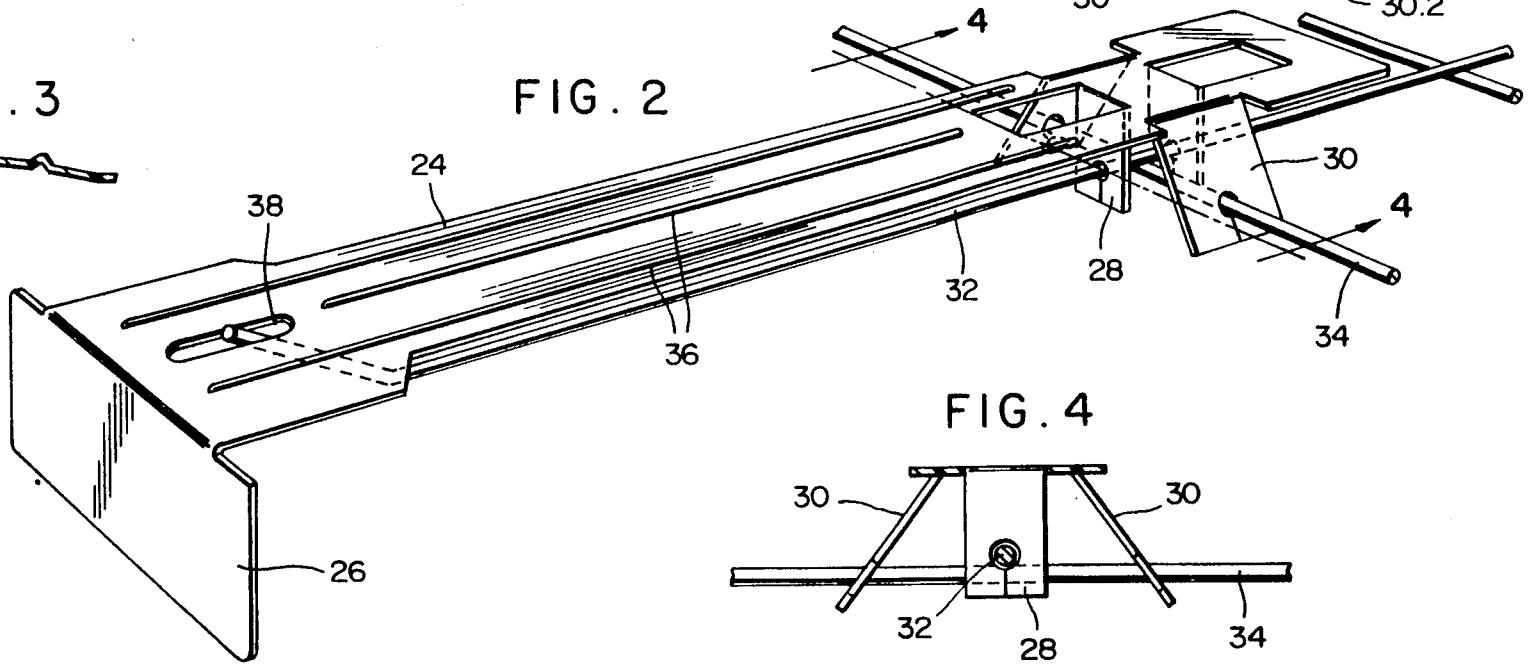
FIG. 2
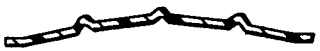
FIG. 3
FIG. 4

94
96
82
13
90
92.1
92.2
92
84
12
36
80
38
88
86
70.1
70.2
70

FORWARDLY EXTENDING IDENTIFICATION TAG

This is a continuation of application Ser. No. 07/476,302, filed Feb. 7, 1990 which was abandoned upon the filing thereof.

BACKGROUND OF THE INVENTION

The invention relates to product identification and information display tags for merchandise suspended from horizontally extending elongate support hooks, generally formed of metal rods, which fit into an apertured board. More particularly, the invention relates to such tags which are easily attached to and removed from support hooks without being subject to inadvertent removal, and which display product information forwardly of the supported merchandise.

One of the Applicants has in recent years developed a range of product display tags of the above-type for use with different types of support hooks, the tags in general being formed from plastic sheet so as to provide a mounting portion which attaches to a support hook at the back or proximal end of the hook, and an elongate portion which extends forwardly over the support hook, and the product suspended therefrom, for presenting product information at the forward or distal end of the support hook. See for example U.S. Pat. Nos. 4,525,944, 4,703,570 and 4,715,135.

The product information may, for example, be provided on a label secured to a downwardly depending display portion of the tag located forwardly with respect to the distal end of the support hook so that the product information is conveniently displayed to a consumer or the like at a location forwardly of the merchandise. With the display tags of this nature, when a product is to removed from the support hook, the tag may be flexed upwardly and may fall back into position after the product has been released from the hook.

Apart from the above-mentioned identification tags, other tags have been developed, such as those illustrated in FIGS. 15 and 16 of the drawings accompanying this application, which are molded from a plastic material and which have bifurcated proximal end mounting portions connected to a longitudinal portion which extends above the support hook and terminating in an identification tag supporting member at the front of the hook. These devices have the disadvantage that a considerable amount of display space is lost due to the presence of the device and it is an object of the present invention, in one of its embodiments, to overcome this disadvantage. A further disadvantage of these devices is that they are not as easily flexed upwardly so that it is not as easy and convenient to place products on or remove products from the hook.

It is a further object of the invention to provide a practical and convenient identification tag for use with bi-directional wire racks, according to another embodiment of the invention.

It is still a further object of the present invention to provide a forwardly extending identification tag which is more stable in the longitudinal direction and resistent to side-ways movement relative to the support hook than the presently known identification tags and yet is easily flexed upwardly for easy placement and removal of products from the hook.

SUMMARY OF THE INVENTION

In accordance with the invention, there is provided a sheet material product information display tag structure for use on a forwardly extending support hook, the tag structure comprising a proximal end mounting portion for securing same to the back or proximal end of the hook, an elongate portion adjacent the mounting portion for extending forwardly from the hook to present product information at a distal end of the elongate portion, and at least one tab or flap, having a bar-receiving cut-out therein, on the structure which is connected to the structure along one end thereof and foldable about said end to receive a forwardly extending part of the hook in the bar-receiving cut-out. The flap which extends with its bar-receiving cut-out portion around the forwardly extending bar or rod of a support hook promotes longitudinal stability of the identification tag and limits side-ways movement of the tag relative the support hook.

The flap may be die cut from the sheet material of the structure. It may be provided with a fold line along the end thereof which is connected to the structure. In this way, the flap is in use, easily folded out of alignment with the elongate portion of the structure to extend with its bar-receiving cut-out around the support hook.

According to another embodiment of the invention, four of the flaps may be provided and located on the proximal end mounting portion of the structure, the flaps being arranged in first and second opposed pairs, the first opposed pair for receiving, in their bar-receiving cut-outs, a bar or rod which extends longitudinally of the elongate portion, and the second opposed pair for receiving, in their bar-receiving cut-outs, a bar or rod extending transversely of the elongate portion. This type of structure is suitable for use with a bi-directional wire rack where the tag is to be attached to a pair of wires or bars which are at right angles to each other. In this instance, the flaps promote easy attachment of the structure to the bars and also promote longitudinal stability of the structure on the bars.

According to another embodiment of the invention, the flap is located on the elongate portion of the structure and it may be die cut from the elongate portion. Two of the flaps may be provided which are spaced along the length of the elongate portion and when the structure is used on a support hook, either one or both of the flaps may be folded down to extend with their bar-receiving cut-outs around the support hook.

The proximal end mounting portion of the structure may comprise a tongue-shaped member which is connected to the elongate portion along a transverse fold line and provided with a pair of longitudinal parallel spaced guide ribs centrally of the tongue for receiving a downwardly depending end of a support hook therebetween. Thus, when the structure is attached to the support hook, the downwardly depending end of the hook is guided between the ribs and because of the relative thinness of the plastic sheet material from which the structure is made, it is not necessary to provide a tongue which is in bifurcated form as is required, for example, with the known types of structures illustrated in FIGS. 15 and 16. However, a slit may be provided in the tongue between the guide ribs which will flex both sides of the tongue for easier insertion of the tongue at the proximal mounting end of the hook. Furthermore, no display space is sacrificed due to the fact that the tag is of sheet material and by the use of the tongue which is connected to the elongate portion along a fold line and which is easily bent down prior to use.

Additional features and advantages of the invention will become apparent from the following description and claims read in conjunction with the attached drawings.

BRIEF DESCRIPTION OF DRAWINGS

FIG. 1 is a plan view of a sheet material product information display tag structure according to the invention, in its flat condition prior to being folding along its several fold lines;

FIG. 2 is a three-dimensional view of the structure of FIG. 1 after it has been folded along its several fold lines and attached to a support hook on a bi-directional wire rack;

FIG. 3 is a section taken along the lines 3—3 in FIG. 1;

FIG. 4 is a section taken along the lines 4—4 in FIG. 2;

DESCRIPTION OF PREFERRED EMBODIMENTS

Figure 5:
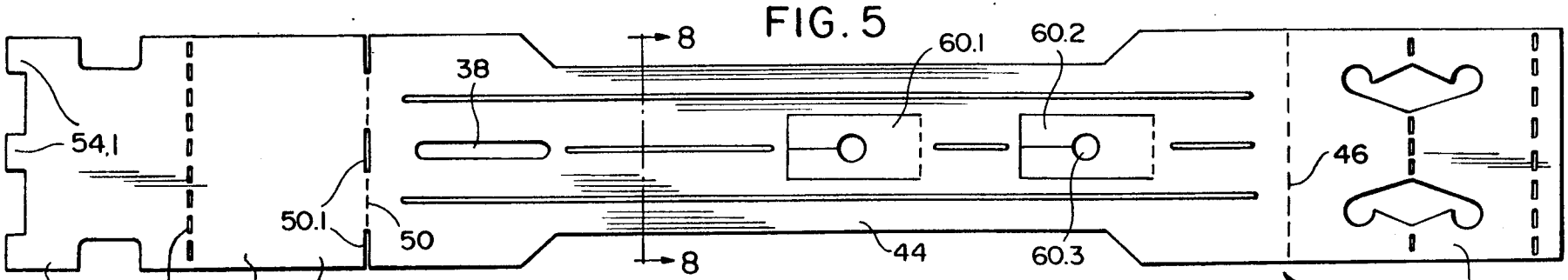
FIG. 5 is a plan view of a sheet material product information display tag structure according to another embodiment of the invention, shown in a flat condition prior to being folded along its several fold lines.

Referring first to FIGS. 1-4 of the drawings, reference numeral 20 generally indicates an information display tag structure comprising a proximal end mounting portion 22, an elongate portion 24 and a display portion 26. The entire structure is pressed from a plastic sheet material and further includes a first pair of opposed tabs or flaps 28 and a second pair of opposed tabs or flaps 30. All the flaps are integrally formed with the structure 20. The flaps 28 are die cut from the sheet material along three sides 28.1, 28.2 and 28.3. Each flap 28 is connected to the structure along one side 28.4 and a fold line is provided along this side so that the flaps 28 can be folded out of alignment with the elongate portion 24 to engage with a bar 32 extending length-wise of the elongate portion 24. The flaps 28 have cut-outs 28.5 for receiving the bar 32 therein. A cut 28.6 is provided between each cut-out 28.5 and the side 28.2 to enable the bar 3 to be inserted into the cut-out 28.5.

The second pair of opposing flaps 30 project transversely of the structure and are cut along their sides 30.1, 30.2 and 30.3 and each has a forth side 30.4 along which it is attached to the structure 20. A fold line is provided along this side. The flaps 30 have bar-receiving cut-outs 30.5 for receiving a transverse bar 34 therein. A cut 30.6 is provided between the cut-out 30.5 and the side 30.2 on each flap 30 to enable the bar 34 to be inserted into the cut-out 30.5. Each flap 30 is further provided with a central reinforcing rib 30.6. The elongate portion 24 is also provided with a plurality of longitudinal reinforcing ribs 36. This is to enhance the longitudinal rigidity of the structure 20. The function and nature of the reinforcing ribs 36 have been fully described in U.S. Pat. No. 4,715,135, the contents of which is incorporated herein by reference.

The cut-outs 28.5 on the first opposed pair of flaps 28 are located at corresponding distances from the sides 30.4. Likewise the cut-outs 30.5 in the second pair of opposed flaps 30 are located at corresponding distances from the sides 30.4, the distances in the latter case being greater than that of the former case to make provision for the fact that the bar 32 crosses over the bar 34 and thus that the bars are not located at the same vertical level.

The structure 20 has an elongate aperture 38 for accommodating the front hook part of the bar 32.

Figure 6:
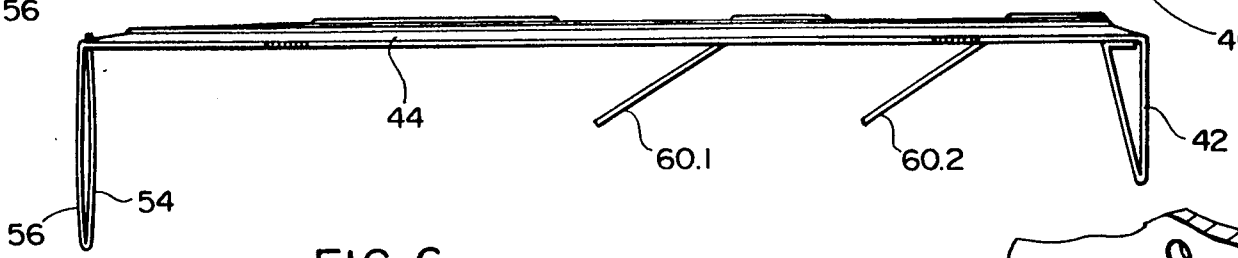
FIG. 6 is a side view of the structure of FIG. 5 after being folded along its several fold lines.

Referring now to FIGS. 5-8, a product information and display tag 40 according to another embodiment of the invention is shown. The tag 40 is die cut from plastic sheet material and formed at a proximal end thereof with a mounting portion 42 for securing the tag at the proximal end of a support hook or the like when the mounting portion 42 is suitably folded. The mounting portion 42 is fully described in U.S. Pat. No. 4,525,944, the contents of which is incorporated herein by reference. An elongate portion 44, for extending over the support hook, is separated from the portion 42 by a transverse fold line 46, and a product information and display portion 48 is provided at a distal end of the tag 40, separated from elongate portion 44 by another fold line 50. A further fold line 52 is provided separating a rear portion 54 and a front portion 56 of the display portion. The portion 54 is provided with lips 54.1 and slots 50.1 are provided along the fold line 50 so that the lips 54.1 can be inserted into the slots 50.1 wherein the display portion is folded over on itself as shown in FIG. 6, to contain an information tag therein.

Figure 7:
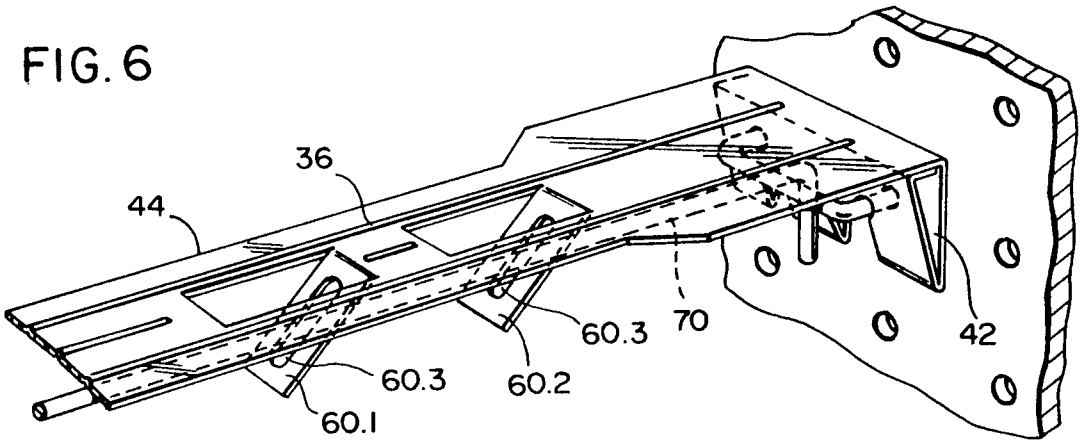
FIG. 7 is a fractional three-dimensional view of a similar structure in its folded condition when attached to a support hook.
Figure 8:
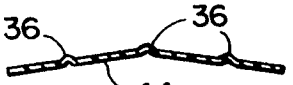
FIG. 8 is a section taken along the lines 8—8 in FIG. 5.
Figures 9, 10, 11, 12, 13:
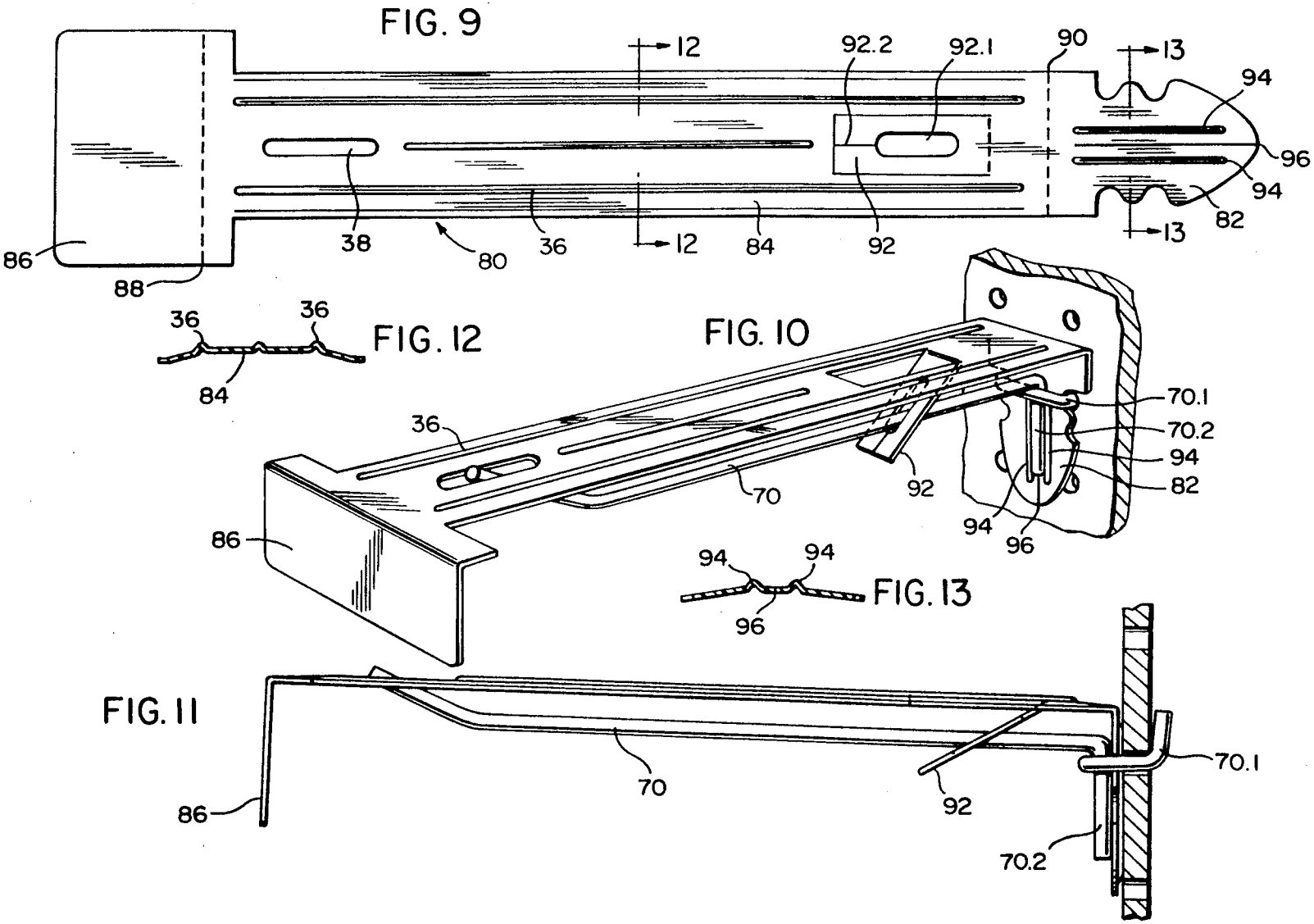
FIG. 9 is a plan view of a sheet material product information display tag structure according to another embodiment of the invention in its flat condition prior to being folded along its several fold lines.
FIG. 10 is a three-dimensional view of the structure of FIG. 9 after having been folded along its several fold lines and attached to a support hook.
FIG. 11 is a side view of the structure shown in FIG. 10.
FIG. 12 is a section taken along the lines 12—12 in FIG. 9.
FIG. 13 is a section taken along the lines 13—13 in FIG. 9.

A front tab or flap 60.1 and a rear flap 60.2 are provided in the elongate portion 44 and spaced along the length of the elongate portion 44. The flaps 60.1 and 60.2 are die cut from the sheet material along three of their sides and are connected to the structure along one side along which a fold line is provided. The flaps 60.1 and 60.2 further have bar-receiving cut-outs 60.3 for receiving the forward extending part of a product support hook 70 therein. The cut-outs 60.3 may either be circular as shown in FIG. 5 or they may be elongate in shape as shown in FIG. 7 or they may have the shape shown in FIG. 14. The flaps 60.1 and 60.2 stabilize the tag on the hook and they also act as stoppers for products on the hook. They may either be used singly or jointly. When used singly, either the front or the rear flap may be used, depending on the number of articles or products on the hook. Thus, if there are only a few products on the hook, the front flap 60.1 may be used. The tag 40 is also provided with longitudinal reinforcing ribs 36 and an elongate opening 38 for accommodating the front of the support hook 70.

Referring now to FIGS. 9–13, a product information and display tag 80 according to another embodiment of the invention is shown.

The tag 80 comprises a mounting portion 82, an elongate portion 84 and a product information and display portion 86 at a distal end of the tag 80. The tag 80 is also provided with longitudinally extending reinforcing ribs 36 and an elongate aperture 38 for accommodating the front part of a support hook 70.

The information and display portion 86 is separated from the elongate portion 84 by means of a fold line 88. The mounting portion 82 is likewise separated from the elongate portion 84 by means of a fold line 90.

The tag 80 is provided with a tab or flap 92 which is die cut from the elongate portion 84, along three sides and connected to the elongate portion 84 along a fourth side. A fold line is provided along the fourth side. The flap 92 has an elongate bar-receiving cut-out 92.1 therein for receiving the support hook 70 therein. A slit 92.2 is provided between the cut-out 92.1 and a side of the flap 92 for inserting the support hook 70 into the cut-out 92.1. The fact that the cut-out 92.1 is elongate in shape allows the tag to be used with hooks which are located at a range of different distances below the tag 80 and it also promotes easy attachment of the tag 80 to the hook 70.

The flap 92 stabilizes the tag 80 on the hook and it also acts as a stopper for products which are suspended from the hook 70.

The mounting portion 82 is in the form of a tongue having suitable cut-outs on its opposite sides for fitting between the opposite sides of the horizontal mounting member 70.1 of the support hook 70. A pair of spaced apart parallel guide ribs 94 are provided for receiving the downward depending part 70.2 of the support hook 70 therebetween. A slit 96 is provided between the guide ribs 94 to facilitate insertion of the tongue between the opposite sides of the horizontal mounting member 70.1

Figure 15:
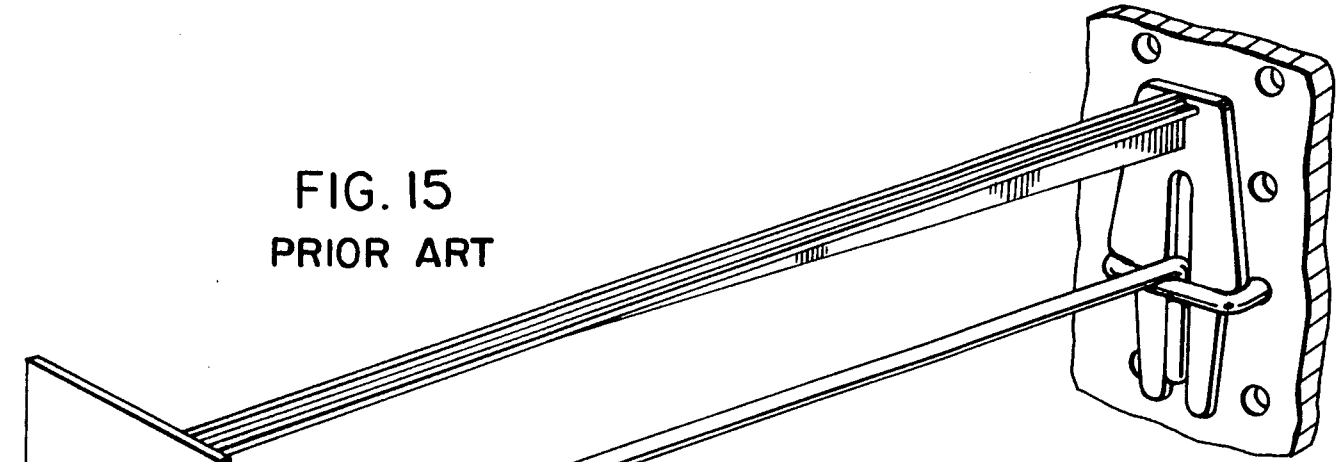
FIG. 15 PRIOR ART
FIGS. 15 and 16 are three-dimensional views of two known identification tag structures.
Figure 16:
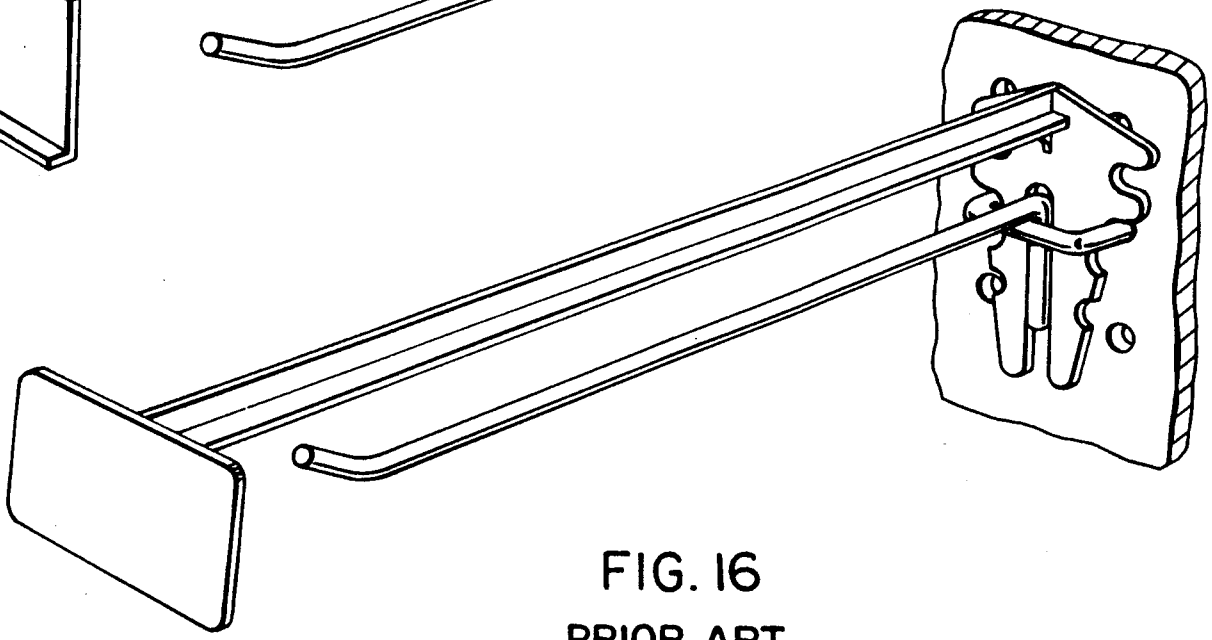
FIG. 16 PRIOR ART

Due to this particular construction, no display space is lost by virtue of the presence of the tag 80 on the hook 70. Furthermore, due to the relative thinness of the plastic sheet material from which the tag 80 is die cut, no slot is required in the tongue as is the case with the known articles, shown in FIGS. 15 and 16, and which are made from a thicker material.

Figure 14:
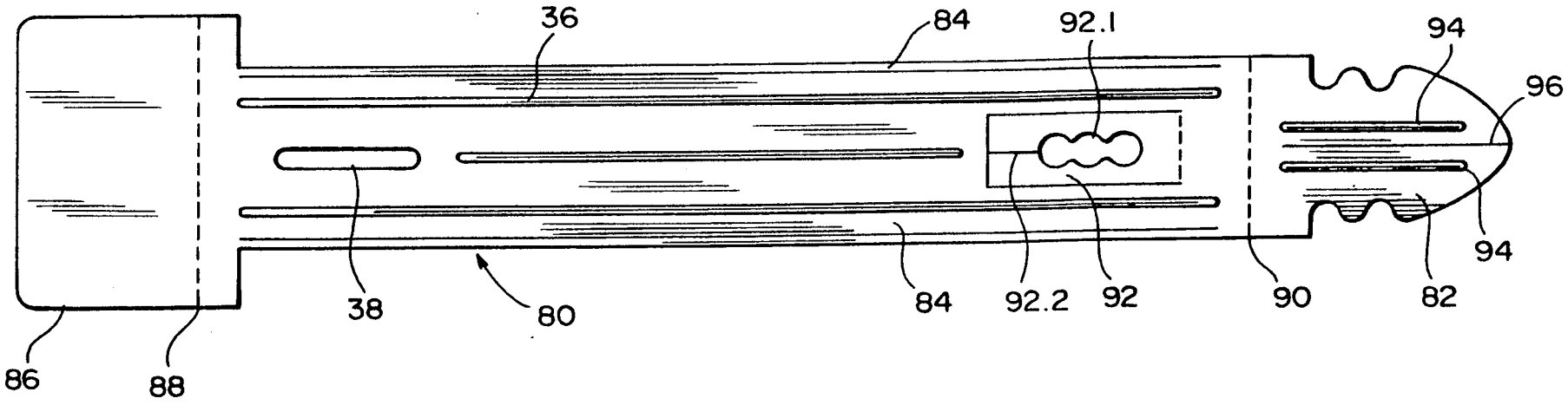
FIG. 14 is a plan view of a sheet material product information display tag structure according to another embodiment of the invention in its flat condition prior to being folded along its several fold lines.

Referring finally to FIG. 14 of the drawings, a product information and display tag 100 according to yet another embodiment of the invention is shown. The tag 100 is similar to the tag 80, and like parts are noted by like reference numerals, except that the cut-out 92.1 does not have straight elongate sides, as is the case with the tag 80, but is formed as three circular openings which partly overlap to form an elongate slot, as shown. Thus, the hook 70 can be engaged in any one of three possible positions, promoting longitudinal stability of the tag 100 on the hook 70.

While only preferred embodiments of the invention have been described herein in detail, the invention is not limited thereby and modifications can be made within the scope of the attached claims.

We claim:

1. An elongate product information display tag structure of sheet material for use on a forwardly extending support hook, the tag structure comprising:

a proximal end mounting portion for securing the tag structure to a proximal end of the hook;

an elongate portion adjacent the mounting portion for extending forwardly of the hook to present product information at a distal end of the elongate portion; and at least one flap, having plural sides and a barreceiving cut-out therein, and which is connected to the structure along one of said sides, the flap being surrounded entirely by the sheet material and foldable about said one of said sides to receive a forwardly extending part of the hook in the bar-receiving cut-out, the bar-receiving cut-out being spaced from said one of said sides of the flap and the flap having a cut extending from said cut-out to another one of said sides of the flap to enable a bar to be inserted in the cut-out.

2. The display tag structure according to claim 1, wherein the flap is die cut from the sheet material of the structure.

3. The display tag structure according to claim 1, wherein the flap is provided with a fold line along said one of said sides.

4. The display tag structure according to claim 1, wherein two of the flaps are provided and located on the proximal end mounting portion of the structure, the flaps being arranged in a first opposed pair for receiving, in their bar-receiving cut-outs, a bar which extends longitudinally of the elongate portion, and the structure includes a second opposed pair of flaps with bar-receiving cut-outs for receiving, in their bar-receiving cut-outs, a bar extending transversely of the elongate portion.

5. The display tag structure according to claim 4, wherein the flaps of the first opposed pair are die cut from the sheet material of the structure.

6. The display tag structure according to claim 4, wherein each of the flaps is provided with a fold line along said one of said sides.

7. The display structure according to claim 4, wherein the flaps of the second opposed pair are formed integrally with the structure, each of the flaps being connected to the proximal end mounting portion along one end thereof and projecting transversely of the elongate portion.

8. The display tag structure according to claim 7, wherein others of said sides of the flaps of the second opposed pair, which are connected to the proximal end mounting portion, form a pair of opposed spaced apart parallel lines and the elongate portion has a width which is greater than the spacing between the parallel lines.

9. The display tag structure according to claim 4, wherein the bar-receiving cut-outs in each of the flaps of the first and second opposed pairs are circular, the cut-outs in each of the first opposed pair being located at first corresponding distances from said one of said sides of the respective flap and the cut-outs in each of the second opposed pair being located at second corresponding distances from said one of the sides of the respective flap.

10. The display tag structure according to claim 9, wherein the first and second corresponding distances are not equal.

11. The display tag structure according to claim 4, wherein the flaps of the second opposed pair are larger than the flaps of the first opposed pair.

12. The display tag structure according to claim 1, wherein the flap is located on the elongate portion.

13. The display tag structure according to claim 12, wherein the flap is die cut from the elongate portion.

14. The display tag structure according to claim 12, wherein two of the flaps are provided, the flaps being spaced along the length of the elongate portion.

15. The display tag structure according to claim 12, wherein the bar-receiving cut-out on the flap is elongate in shape.

16. The display tag structure according to claim 15, wherein the cut-out comprises a plurality of partly overlapping circular openings.

17. The display tag structure according to claim 12, wherein the proximal end mounting portion comprises:

a tongue-shaped member which is connected to the elongate portion along a transverse fold line and provided with a pair of longitudinal parallel spaced guide ribs centrally of the tongue for receiving a downwardly depending end of a support hook therebetween.

18. The display tag structure according to claim 17, wherein a slit extending longitudinally of the tongue is provided between the guide ribs.

19. In combination with a substantially horizontally extending support hook for the suspension of products thereon, an elongate product information display tag structure of sheet material comprising a proximal end mounting portion securing the tag structure to a proximal end of the hook, an elongate portion adjacent the mounting portion extending forwardly of the hook to present product information at a distal end of the elongate portion, and at lest one flap in said tag structure having plural sides and a bar-receiving cut-out therein, the flap being connected to the structure along one of said sides, being surrounded entirely by the sheet material and being folded about said one of said sides with a part of the hook being received in the bar-receiving cut-out through a cut which extends from the cut-out to another one of said sides of the flap.

20. The combination according to claim 19, wherein the flap is located in the elongate portion of the tag structure.

21. The combination defined in claim 19, wherein the structure includes a second flap spaced lengthwise along said elongate portion of the structure from said at least one flap, with another part of the hook received in a bar-receiving cut-out of the second flap.

* * * * *